US008413566B2

(12) United States Patent
Bettencourt et al.

(10) Patent No.: US 8,413,566 B2
(45) Date of Patent: Apr. 9, 2013

(54) ARMOURED DOOR FOR A CREW COMPARTMENT

(75) Inventors: Benoit Bettencourt, Chaville (FR); Jacky Jacquemont, Igny (FR); Christian Noel, Asnières sur Seine (FR); Xavier Poirmeur, Guyancourt (FR)

(73) Assignee: Nexter Systems, Roanne (FR)

( * ) Notice: Subject to any disclaimer, the term of this patent is extended or adjusted under 35 U.S.C. 154(b) by 0 days.

(21) Appl. No.: 12/737,101

(22) PCT Filed: Jun. 10, 2009

(86) PCT No.: PCT/FR2009/000688

§ 371 (c)(1),
(2), (4) Date: Dec. 8, 2010

(87) PCT Pub. No.: WO2010/004108

PCT Pub. Date: Jan. 14, 2010

(65) Prior Publication Data

US 2011/0079136 A1 Apr. 7, 2011

(30) Foreign Application Priority Data

Jun. 12, 2008 (FR) ..... 08 03326

(51) Int. Cl.
*F41H 7/02* (2006.01)

(52) U.S. Cl. ..... 89/36.08; 89/36.02

(58) Field of Classification Search ..... 89/36.07, 89/36.08, 36.09; 296/187.07, 146.1, 187.02, 296/187.03

See application file for complete search history.

(56) References Cited

U.S. PATENT DOCUMENTS

| | | | | |
|---|---|---|---|---|
| 3,075,254 | A * | 1/1963 | Jacobson et al. | 49/483.1 |
| 3,159,093 | A * | 12/1964 | Rosenfeld | 49/401 |
| 5,322,338 | A * | 6/1994 | Hirakami | 296/151 |
| 6,698,331 | B1 * | 3/2004 | Yu et al. | 89/36.02 |
| 8,096,223 | B1 * | 1/2012 | Andrews | 89/36.02 |
| 2003/0057737 | A1 * | 3/2003 | Bock et al. | 296/188 |
| 2006/0213360 | A1 * | 9/2006 | Ravid et al. | 89/36.01 |
| 2008/0314236 | A1 * | 12/2008 | Savage et al. | 89/36.02 |

FOREIGN PATENT DOCUMENTS

| | | | |
|---|---|---|---|
| DE | 4219345 | A1 * | 12/1993 |
| EP | 1 790 815 | | 5/2007 |
| FR | 2 860 542 | | 4/2005 |
| FR | 2 870 880 | | 12/2005 |

* cited by examiner

*Primary Examiner* — Gabriel Klein
(74) *Attorney, Agent, or Firm* — Steptoe & Johnson LLP

(57) ABSTRACT

The invention relates to an armored door (5) for the crew compartment of a vehicle or fixed shelter, such door intended to block an opening (10) into the compartment and incorporating a structure (7) to the exterior of which at least one armor plate (12) is fastened.

The armor plate (12) is fixed at a distance from the structure (7) and is separate from said structure by first deformable intermediate means (14) able to absorb part of the energy of a shock, the armor plate (12) having, furthermore, dimensions that are greater than those of the structure (7), and second deformable intermediate means (15) positioned between the rim (R) of the armor plate (12) and a wall (8) of the compartment surrounding the opening (10).

9 Claims, 2 Drawing Sheets

ARMOURED DOOR FOR A CREW COMPARTMENT

This application is a national stage entry of International Application No. PCT/FR2009/000688, filed Jun. 10, 2009 designating the U.S., which claims the benefit of French Application No. 08.03326, filed Jun. 12, 2008.

TECHNICAL FIELD OF THE INVENTION

The technical scope of the invention is that of armoured doors or opening hatches and in particular armoured doors enabling the opening in a crew compartment to be blocked, for example that of a vehicle (or immobile shelter).

TECHNICAL BACKGROUND OF THE INVENTION

It is known to make armoured doors that associate at least one armour plate and a support structure incorporating hinges and lock.

However, despite the add-on protection, armoured doors form a discontinuity on the armoured wall of a compartment and they still constitute a zone at which protection is reduced. Indeed, when an improvised explosive device is ignited nearby, the door is deformed. The hinges and fastening devices are destroyed. Part of the door may be projected inside the crew compartment whereas the rebound effect may lead to the door being ejected outwards after the explosion.

DISCLOSURE OF THE INVENTION

The aim of the invention is to propose a structure that enables the resistance of the door or hatch to be reinforced and thus reduces the risk of this element being projected inwards inside the compartment.

Thus, the invention relates to an armoured door for the crew compartment of a vehicle or fixed shelter, such door intended to block an opening into the compartment and incorporating a structure to the exterior of which at least one armour plate is fastened, such door wherein the armour plate is fixed at a distance from the structure and is separated from said structure by first deformable intermediate means able to absorb part of the energy of a shock, the armour plate having, furthermore, dimensions that are greater than those of the structure, and second deformable intermediate means positioned between the rim of the armour plate and a wall of the compartment surrounding the opening.

The first deformable intermediate means are preferably arranged at a peripheral zone of the door structure, a free space being provided between the armour plate and the structure so as to enable the plate to deform without impacting on the structure.

The second deformable intermediate means may be integral with the armour plate.

Alternatively, the second deformable intermediate means may be integral with the compartment wall.

The first and second deformable intermediate means are preferably made in the form of blocks of metallic foam.

The metallic foam will be, for example, aluminium foam.

DESCRIPTION OF THE DRAWINGS

The invention will become more apparent from the following description of a particular embodiment, such description being made with reference to the appended drawings, in which.

DETAILED DESCRIPTION OF THE INVENTION

Figure 1:
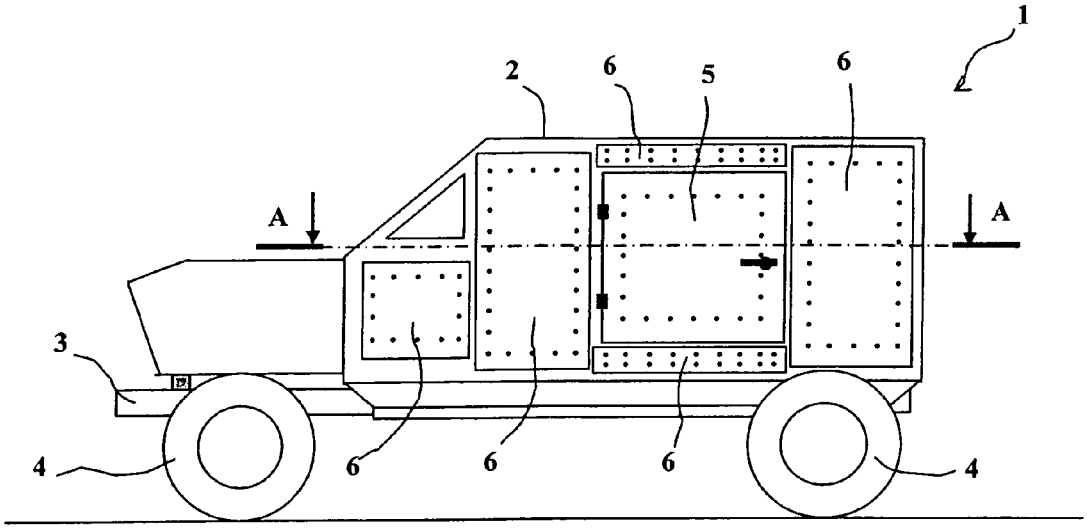
FIG. 1 shows a light armoured vehicle incorporating an armoured side door.

FIG. 1 shows a light armoured vehicle 1 that comprises a cab 2 fixed on a chassis 3 equipped with wheels 4. The inside of the cab is accessed by a door 5. The external wall of the cab is provided with add-on protection made in the form of armour plates 6 that are fastened to the wall of the cab 2.

The door 5 is also reinforced by an armour plate 12.

Figure 2:
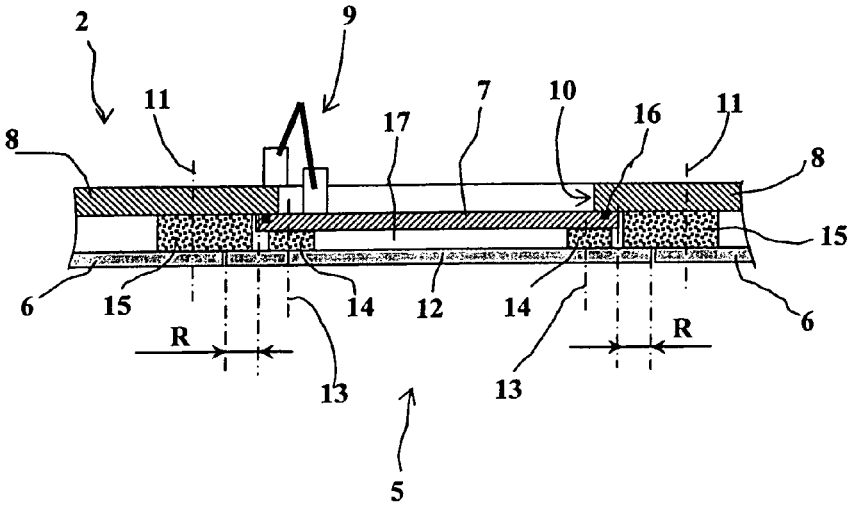
FIG. 2 is a section view of the door and the vehicle walls, such section being made along the plane referenced AA in FIG. 1.

FIG. 2 details the structure of the door according to the invention and its cooperation with the cab 2.

The wall 8 of the cab is covered with armour plating 6. This is fastened to the wall by means of screws (of which only the axis 11 is shown). The wall incorporates an opening 10 blocked by the door 5.

The door 5 comprises a structure 7 mounted able to pivot on a wall 8 of the cab 2. The articulation 9 of the door is shown here schematically. It comprises several connecting rods defined so as to ensure the required opening movement given the relative thicknesses of the door 5 and wall 8 carrying the armours 6.

An armour plate 12 is fastened to the structure 7 of the door 5 by screws (of which only the axis 13 is shown here).

In FIG. 2, the armour plate 12 can be seen to be fastened at a distance from the structure 7 from which it is separated by means of the first intermediate means 14 that are deformable and able to absorb part of the energy from a shock received by the armour plate 12.

These intermediate means 14 are preferably made in the form of blocks of metallic foam, and in particular aluminium foam. Such a material ensures the rigidity of the link during the phases of normal use of the vehicle. It allows, however, substantial deformation during a shock and thus ensures the absorption of the energy received.

FIG. 2 also shows that the armour plate 12 has dimensions that are greater than those of the structure 7. A rim R of the armour plate 12 thus overhangs the structure 7 and presses on the second intermediate means 15 which are also deformable.

These second deformable means 15 are thus positioned between the rim R of the armour plate 12 and the wall 8 of the compartment surrounding the opening 10.

In accordance with the embodiment shown in FIG. 2, the second intermediate means 15 are also positioned between the armour plates 6 and the walls 8 of the cab. These intermediate means 15 are also preferably made in the form of blocks of metallic foam, such as aluminium foam.

Thus, when the door 5 is closed, the inner face of its structure 7 comes into contact with the periphery of the opening 10. A sealing joint 16 integral with the door comes into contact with the wall 8. At the same time, the rim R of the armour plate 12 integral with the structure 7 presses against the second intermediate means 15.

Figure 3:
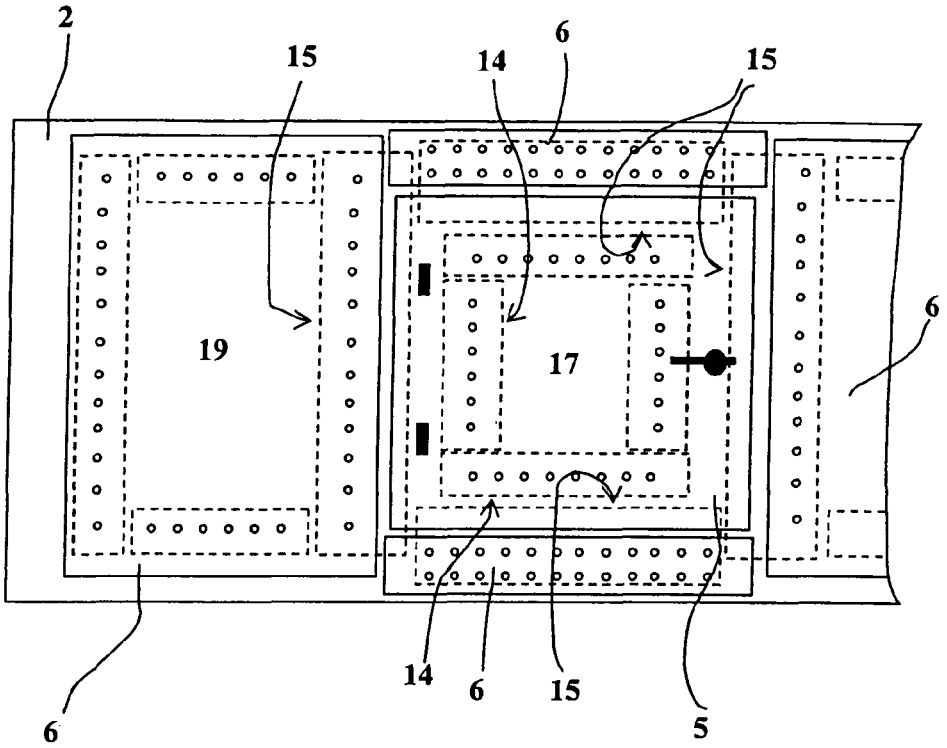
FIG. 3 is a side view of the door enabling the location of the intermediate shock absorbing means to be displayed.

FIG. 3 shows that the first intermediate means 14 are made in the form of four parallelepipedic blocks that are arranged in a peripheral zone of the structure 7. The blocks 14 are thus parallel to the sides of the armour plate 12.

There is thus a median zone 17 of the door where there is no shock-absorbing material. Thus, inside the door 5, between the inner structure 7 and the armour plate 12, there remains an empty zone 17 (or free space) that has no shock absorbing means. This free space enables a deformation of the plate 12 under the effect of the blast from an explosion. This deformation occurs without there being an impact of the plate 12 on the structure 7.

Such an arrangement permits part of the energy of the shock to be consumed by the deformation of the plate without the structure 7 being destroyed as a result.

Furthermore, the second intermediate means 15 are also made in the form of parallelepipedic blocks parallel to the side of the armour plates 6. The latter are thus also able to deform without impacting the wall 8 of the cab and a free space 19 (see FIG. 3) is arranged between the armour plates 6 and the wall 8.

In accordance with the invention, the rims R of the armour plate 12 of the door 5 press on the compressible blocks of the second intermediate means 15. Thus, the mechanical load generated by the explosion will be transmitted by the armour plate 12 on the one hand to the first intermediate means 14 and on the other to the second intermediate means 15. The latter are themselves pressing on the wall 8, the latter recovers the majority of the load received, thereby relieving the structure 7 of the door. There is thus no longer a discontinuity in protection despite the presence of the door. The destruction of the hinges and locks is thereby avoided as is the projection of parts of the structure inside the compartment.

FIGS. 2 and 3 show an embodiment in which the compressible blocks 15 of the second intermediate means are integral with the armour plates 6 and the cab 8.

Figure 4:
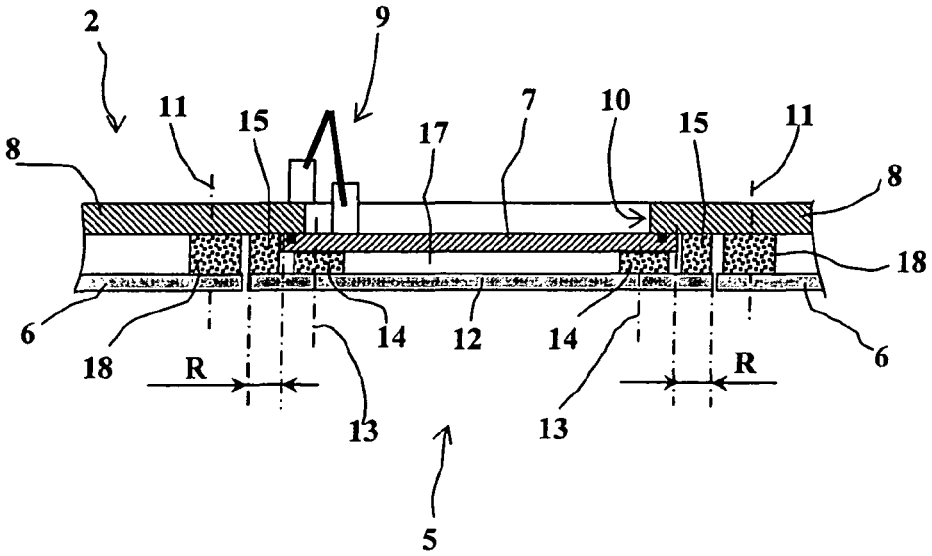
FIG. 4 is an analogous section view to that in FIG. 2 but showing another embodiment.

FIG. 4 shows another embodiment in which the compressible blocks 15 are integral with the armour plate 12 fastened to the structure 7 of the door 5. These blocks are fastened, for example, by bonding. They press against the wall 8 of the cab when the door is closed. Other compressible blocks 18 are thus provided that are positioned between the fixed armour plates 6 and the cab wall 8.

By way of a variant, the first and second deformable intermediate means (14 and 15) may be made in the form of foam of another metal or else in the form of deformable blocks or caissons.

By way of a variant, and regardless of the protection adopted for the doors or hatches, it is possible for an armouring structure as described previously with reference to FIG. 4 to be implemented alone to protect a compartment or vehicle, in which case a free space 19 will be arranged between an external armour plate 6 and an internal armour plate 8. Deformable intermediate means 18 are thus positioned in a peripheral zone of the armour plate 6, the free space 19 thus arranged permitting a deformation of the armour plate without impacting the inner wall.

The invention claimed is:

1. An armored door for a compartment, wherein the door is intended to block an opening in a wall of such a compartment, wherein the door comprises:

a structure comprising an inner face for contacting such a wall at the periphery of such an opening, an armor plate distant from said structure, first deformable blocks of metallic foam and second deformable blocks of metallic foam, wherein the first deformable blocks are fixed to the exterior of said structure and to said armor plate, wherein the dimensions of the armor plate are greater than those of the structure, a rim of the armored plate overhanging the edges of the structure, wherein the second deformable blocks are positioned at and at least in part within the peripheral dimensions of the rim of the armored plate for pressing between the rim of the armored plate and a wall of such a compartment.

2. An armored door according to claim 1, wherein the first deformable blocks are arranged at a peripheral zone of the structure, and wherein a free space exists between the armor plate and the structure to enable the plate to deform without impacting the structure.

3. An armored door according to claim 1, wherein the metallic foam is aluminum foam.

4. An armored door according to claim 1, in combination with a wall of a compartment having an opening in said wall, wherein the second deformable blocks are fixed to the wall of the compartment surrounding the opening, for pressing against the rim of the armor plate.

5. An armored door in combination with a wall of a compartment according to claim 1, wherein the first deformable blocks are located at a peripheral zone of the structure, and wherein a free space exists between the armor plate and the structure to permit the armor plate to deform without impacting the structure.

6. An armored door according to claim 1 in combination with a wall of compartment.

7. An armored door in combination with a wall of a compartment according to claim 6, wherein the metallic foam is aluminum foam.

8. An armored door according to claim 4, wherein the second deformable blocks are fixed to the rim of the armor plate.

9. An armored door according to claim 1, in combination with a wall of a compartment of a vehicle.

* * * * *